US008061439B2

(12) United States Patent
Nelson

(10) Patent No.: US 8,061,439 B2
(45) Date of Patent: Nov. 22, 2011

(54) ISOLATOR PLATE ASSEMBLY FOR ROCK BREAKING DEVICE

(76) Inventor: Craig Nelson, Luck, WI (US)

( * ) Notice: Subject to any disclaimer, the term of this patent is extended or adjusted under 35 U.S.C. 154(b) by 19 days.

(21) Appl. No.: 11/873,067

(22) Filed: Oct. 16, 2007

(65) Prior Publication Data

US 2009/0096275 A1 Apr. 16, 2009

(51) Int. Cl.
*B25D 17/24* (2006.01)

(52) U.S. Cl. ..... 173/210; 173/162.1; 173/128

(58) Field of Classification Search ..... 173/128, 173/133, 206, 210
See application file for complete search history.

(56) References Cited

U.S. PATENT DOCUMENTS 4,018,291 A * 4/1977 Anderson ..... 173/135
4,724,912 A * 2/1988 Miyazaki et al. ..... 173/162.1
4,759,412 A * 7/1988 Brazell, II ..... 173/185
4,838,363 A * 6/1989 MacOnochie ..... 173/210
5,088,564 A * 2/1992 Kobayashi ..... 173/1
D326,857 S * 6/1992 Ikeda et al. ..... D15/21
5,117,925 A * 6/1992 White ..... 173/162.1
5,167,396 A * 12/1992 Burba et al. ..... 248/610
5,263,544 A * 11/1993 White ..... 173/162.1
5,285,858 A * 2/1994 Okada et al. ..... 173/211
5,355,964 A * 10/1994 White ..... 173/1
5,363,835 A * 11/1994 Robson ..... 125/40
6,000,477 A * 12/1999 Campling et al. ..... 173/100
6,095,257 A * 8/2000 Lee ..... 173/211
6,119,795 A * 9/2000 Lee ..... 173/114
6,227,307 B1 * 5/2001 Lee ..... 173/78
6,257,352 B1 * 7/2001 Nelson ..... 173/211
D457,534 S * 5/2002 Kim ..... D15/21
6,732,814 B2 * 5/2004 Heinonen et al. ..... 173/199
D547,775 S * 7/2007 Tuscuoğlu ..... D15/21
7,628,222 B2 * 12/2009 Yoshimura et al. ..... 173/162.1

* cited by examiner

*Primary Examiner* — Rinaldi Rada
*Assistant Examiner* — Gloria R Weeks
(74) *Attorney, Agent, or Firm* — Moore & Hansen, PLLP

(57) ABSTRACT

A rock breaking device employs a falling weight and a striker pin or other tool held within a tool holding structure supported by a recoil assembly includes a number of isolator structures that protect the rock breaking device by absorbing excess forces that may be applied to the recoil assembly. Each isolator structure includes a front plate that extends below a lower side of a recoil tube flange. In new rock breaking devices, the front plates may be incorporated as part of the isolator structures. Alternatively, an existing rock breaking device can be retrofitted by welding a heavy plate onto the front of an existing front plate of the isolator structures. The heavy plate extends beyond the lower side of the recoil tube flange to provide greater strength.

17 Claims, 5 Drawing Sheets

ISOLATOR PLATE ASSEMBLY FOR ROCK BREAKING DEVICE

TECHNICAL BACKGROUND

The disclosure relates generally to the breaking of rocks, stones, ores, construction materials, and the like, collectively referred to in this disclosure as "rocks," to concrete demolition, to pile driving, and to compaction of sand, dirt, and earth. More particularly, the disclosure relates to devices employing a falling weight to accomplish such tasks.

BACKGROUND

In the construction industry and other industries, it is often desirable to break rocks, stones, ores, construction materials, and the like, collectively referred to in this disclosure as "rocks." Many conventional devices used to achieve this purpose employ a falling weight to break such rocks. In particular, a massive weight is allowed to fall under the influence of gravity and impact a tool that is driven into the rock to break it.

While such devices can be quite effective in breaking rocks, the forces that are imparted by repeated heavy blows from a weight being used to drive a tool can easily exceed the maximum allowed stresses in the materials from which typical rock breaking devices are made, such as steel and cast iron. Some conventional rock breaking devices attempt to address this issue by cushioning the impact of the weight on the tool using, for example, elastomeric cushions or other shock absorbers formed of rubber, leather, or wood. When the cushion or buffer is vertically compressed under the weight, however, it expands laterally. As a result, the cushion or buffer may come into contact with the side walls of the rock breaker and exert sufficient force on the side walls to deform or break them.

Further, in some cases, a weight may drop within a rock breaking device without any object beneath the tool or without support for the tool itself. In this scenario, the entire force of the falling weight is transferred to the tool and the lower end of the rock breaking device. This situation, known as "dry firing" or "bottoming out," results from the force of the falling weight being transferred to the lower end of the rock breaking device rather than to a rock. Bottoming out or dry firing a rock breaking device even once can cause severe damage to the rock breaking device, as well as to any vehicle or stand to which the rock breaking device may be attached.

U.S. Pat. No. 6,257,352, issued to Nelson on Jul. 10, 2001, discloses a rock breaking device that includes a substantially vertical guide column. The guide column houses a weight for delivering an impact to a tool held within a cushioned tool holding structure. The cushioned tool holding structure is supported from the guide column by a resilient recoil assembly mounted at the bottom end of the guide column. When excess force is applied to the recoil assembly, the recoil assembly causes the force of the falling weight to be transferred to and absorbed by elastomeric isolator buffers, reducing the potential for damage to the rock breaking device.

In some conventional rock breaking devices, the tool that is driven into the rock is also used to move the rock into the desired position before breaking it. Using the tool in this manner can impart considerable stress on various components of the rock breaking device. Over time, the integrity of the rock breaking device can be compromised.

SUMMARY OF THE DISCLOSURE

According to various example embodiments, a rock breaking device that employs a falling weight and a striker pin or other tool held within a tool holding structure supported by a recoil assembly includes a number of isolator structures that protect the rock breaking device by absorbing excess forces that may be applied to the recoil assembly during rock breaking and during rock positioning prior to breaking. Each isolator structure includes a front plate that extends below a lower side of a recoil tube flange. In new rock breaking devices, the front plates may be incorporated as part of the isolator structures. Alternatively, an existing rock breaking device can be retrofitted by welding a heavy plate onto the front of an existing front plate of the isolator structures. The heavy plate extends beyond the lower side of the recoil tube flange to provide greater strength.

One embodiment is directed to a device for breaking rocks. The rock breaking device includes a hollow mast having a lower end portion. The hollow mast defines a vertical axis and a channel running at least substantially parallel to the vertical axis. A weight is slidably disposed in the channel. A weight raising arrangement is provided for raising and releasing the weight to allow the weight to fall within the channel under the influence of gravity. A recoil arrangement includes a recoil tube having an upper end portion and a lower end portion extending below the lower end portion of the mast. The recoil tube is resiliently secured proximate the lower end portion of the mast. An upper flange and a lower flange are secured to the upper and lower end portions, respectively, of the recoil tube. An isolator arrangement includes an isolator structure secured proximate the lower end portion of the mast and proximate the upper end portion of the recoil tube and arranged to support the recoil tube. An isolator plate is secured to the isolator structure and extends below the upper flange. A nose block is secured proximate the lower end portion of the recoil tube. The nose block has an upper surface and a bore formed through the nose block so as to slidably receive a tool therein. An impact-absorbing recoil buffer is disposed within the recoil tube in a space defined between the lower end portion of the mast and the upper surface of the nose block. The recoil buffer is constructed and arranged to resiliently absorb impact forces imparted to the recoil buffer by the weight. In some alternative embodiments, the impact-absorbing recoil buffer may incorporate one or more springs.

In another embodiment, a rock breaking device comprises a hollow mast having a lower end portion and defining a vertical axis and a channel running at least substantially parallel to the vertical axis. A weight is slidably disposed in the channel. A weight raising arrangement is provided for raising and releasing the weight to allow the weight to fall within the channel under the influence of gravity. A recoil arrangement comprises a recoil tube having an upper end portion and a lower end portion extending below the lower end portion of the mast. The recoil tube is resiliently secured proximate the lower end portion of the mast. An upper flange is secured to the upper end portion of the recoil tube. A tool holding structure is secured proximate the lower end portion of the recoil tube and is configured to receive a tool. An elastomeric recoil buffer is disposed within the recoil tube in a space defined between the lower end portion of the mast and the upper surface of the nose block. The recoil buffer is constructed and arranged to resiliently absorb impact forces imparted to the recoil buffer by the weight. An isolator arrangement comprises an isolator structure secured proximate the lower end portion of the mast and proximate the upper end portion of the recoil tube and arranged to support the recoil tube. An isolator plate is secured to the isolator structure. The isolator plate extends below the upper flange and is arranged to alleviate stresses imparted to the rock breaking device when the recoil arrangement, tool holding structure, and tool are used to position a rock for breaking.

Various embodiments may provide certain advantages. For instance, when the striker pin, the nose block, and the recoil tube are used to position rocks for breaking, a great deal of stress can be placed on the portion of the mast below the side isolator flange, the side isolator bolts, and the side isolator buffers. Adding the plates to the isolator structures may increase the life of these parts and make the rock breaking device more dependable.

Additional objects, advantages, and features will become apparent from the following description and the claims that follow, considered in conjunction with the accompanying drawings.

DESCRIPTION OF VARIOUS EMBODIMENTS

According to various embodiments, a rock breaking device that employs a falling weight and a striker pin or other tool held within a tool holding structure supported by a recoil assembly includes a number of isolator structures that protect the rock breaking device by absorbing excess forces that may be applied to the recoil assembly. Each isolator structure includes a front plate that extends below a lower side of a recoil tube flange. In new rock breaking devices, the front plates may be incorporated as part of the isolator structures. Alternatively, an existing rock breaking device can be retrofitted by welding a heavy plate onto the front of an existing front plate of the isolator structures. The heavy plate extends beyond the lower side of the recoil tube flange to provide greater strength.

In the following description, numerous specific details are set forth in order to provide a thorough understanding of various embodiments. It will be apparent to one skilled in the art that some embodiments may be practiced without some or all of these specific details. For example, this disclosure recites certain dimensions. Such recitations are provided by way of illustration only, and are not intended to limit the scope of the invention. Indeed, other dimensions may be more appropriate for use with certain models of rock breaking devices. In other instances, well known components and process steps have not been described in detail.

Figure 1:
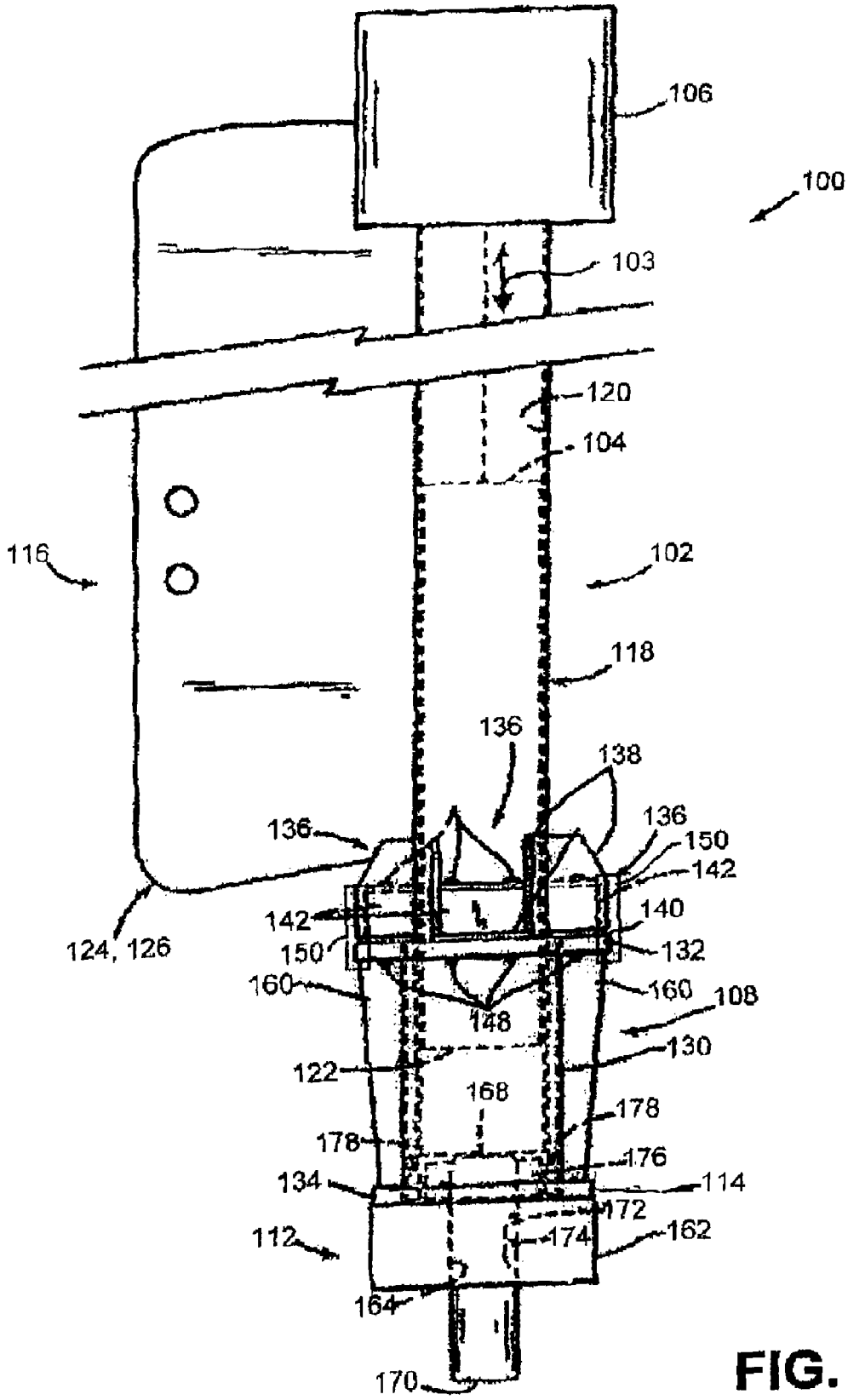
FIG. 1 is a side view of a rock breaking device according to one embodiment.

Referring now to the drawings, FIG. 1 is a side view of a rock breaking device 100 according to one embodiment. The rock breaking device 100 is generally comprised of a guide column 102 constructed and arranged to permit free vertical movement of an impact weight 104 through the guide column 102 in directions 103. A weight raising mechanism 106 is configured and arranged to raise and release the impact weight 104 within the guide column 102. A recoil assembly 108 is secured to a lower end 110 of the guide column 102. A tool holding structure 112 is mounted to a lower end 114 of the recoil assembly 108. A vehicle attachment structure 116 is secured to the guide column 102 to provide a point of attachment for the rock breaking device 100 to a vehicle, such as a front-end loader or excavator (not shown) that is used to transport and position the rock breaking device 100. Alternatively, the rock breaking device 100 can be positioned in other ways, including, for example, mounting upon a stationary rock breaking structure or suspension from a crane.

The guide column 102 of the rock breaking device 100 comprises a tubular mast 118. In one embodiment, the mast 118 has a generally square cross section; however, the mast 118 may have any of a number of suitable cross-sectional shapes, including, but not limited to, a square, rectangular, polygonal, elliptical, or circular cross section. The mast 118 is typically formed from a high strength steel. The mast 118 has a channel 120 running through the mast 118 to guide the vertical travel of the impact weight 104. The impact weight 104 is typically formed from a steel material, but other materials may be used. It is generally desirable, however, that the impact weight 104 should be formed from a material that is strong enough to prevent the rapid deformation of a lower impact surface 122 of the impact weight 104.

The impact weight 104 is coupled to the weight raising mechanism 106 mounted adjacent the upper end of the guide column 102. The weight raising mechanism 106 can be any of a number of well known mechanisms capable of raising and releasing a heavy object, such as the impact weight 104. Examples of suitable weight raising mechanisms include, but are not limited to, hydraulic lifting mechanisms, pneumatic lifting mechanisms, and mechanical mechanisms that may include cable and pulley structures or rotating cam mechanisms. The weight raising mechanism 106 should be capable of repeatedly raising and subsequently releasing the impact weight 104 to allow the impact weight 104 to fall within the channel 120 of the mast 118 under the influence of gravity. Power for the weight raising mechanism 106 is typically supplied by the vehicle or structure on which the rock breaking device 100 is mounted. For example, an air compressor, hydraulic pump, or generator may be mounted on the vehicle or structure to which the rock breaking device 100 is mounted so as to provide the motive power to the weight raising mechanism 106. Alternatively, power for the weight raising mechanism 106 may be provided by an internal combustion engine coupled directly to the weight raising mechanism 106.

In one embodiment, the vehicle attachment structure 116 includes a pair of substantially parallel side plates 124, 126 that are affixed longitudinally to the guide column 102. The plates 124, 126 are maintained in their substantially parallel arrangement by a number of brackets (not shown) welded between the plates 124, 126 in a well known manner. The brackets are further arranged in a known manner to secure the rock breaking device 100 to a vehicle that will be used to deploy the rock breaking device 100. As indicated above, suitable vehicles include front-end loaders and excavators capable of movement through the environments in which a rock breaking device 100 would be used, such as a mine, rock quarry, or construction site. Further, the brackets may instead be arranged in a known manner to secure the rock breaking device 100 to a stationary structure, such as a pedestal or stationary framework, rather than a movable vehicle. Attachment holes are designed to fit the structures generally intended to mount an excavating bucket to either a front-end loader or an excavator.

The rock breaking device 100 functions by transmitting forces from the dropped impact weight 104 to a target rock through a tool 128 mounted in the tool holding structure 112. The recoil assembly 108 prevents the massive forces generated by the falling impact weight 104 from rapidly destroying the tool holding structure 112 and the guide column 102. In addition, the tool holding structure 112 is preferably cushioned to further prevent its rapid destruction.

Figure 2:
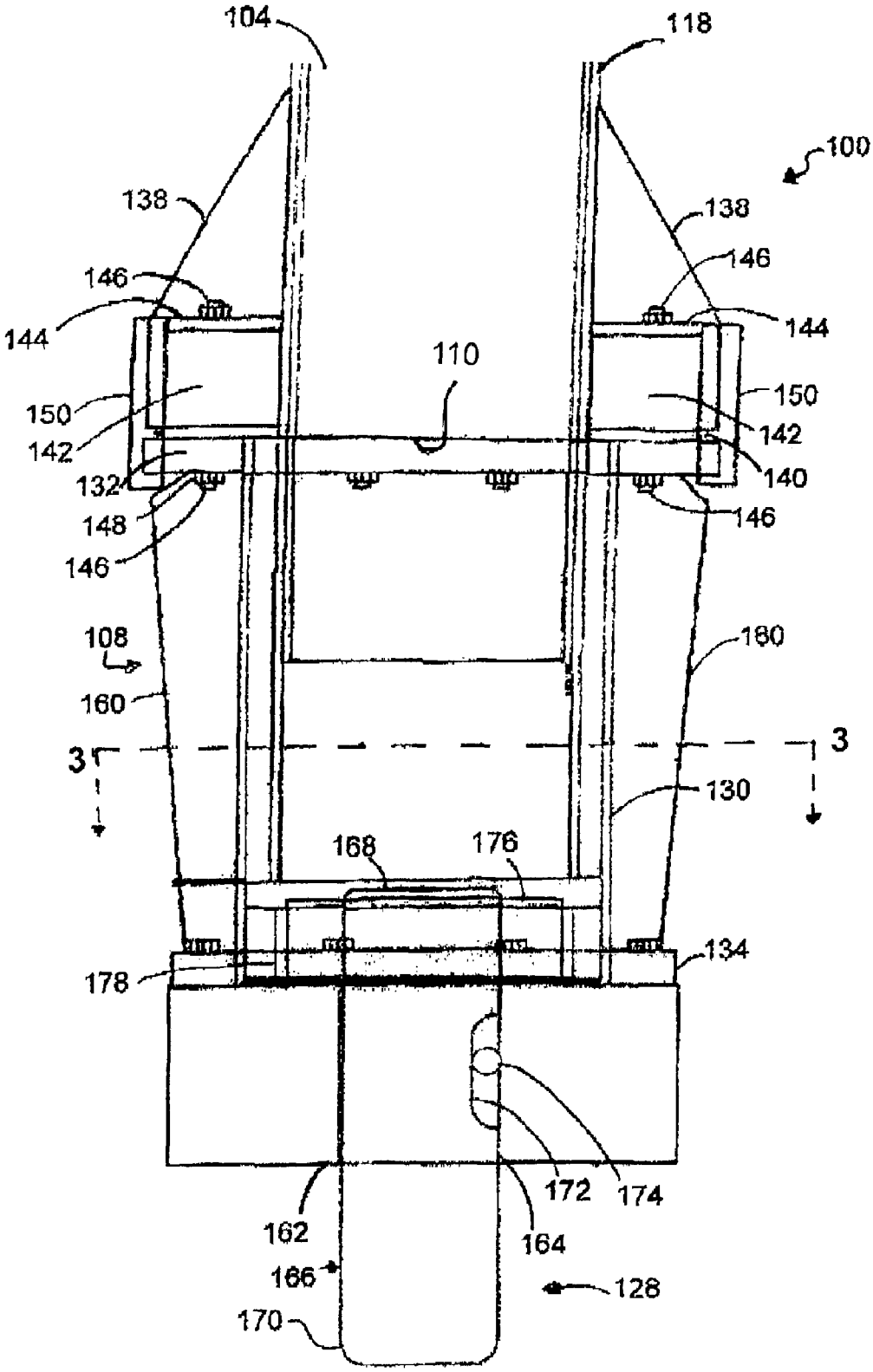
FIG. 2 is a close-up view of a lower end of a guide column and a recoil assembly attached to the guide column of the rock breaking device depicted in FIG. 1.

FIG. 2 illustrates a close-up view of a lower end of the guide column 102 and the recoil assembly 108 attached to the guide column 102 of the rock breaking device 100 depicted in FIG. 1. The recoil assembly 108 includes a recoil tube 130 having a recoil tube flange 132 and a lower flange 134 secured to the upper and lower ends, respectively, of the recoil tube 130. The recoil tube 130 is supported around the lower end of the guide column 102 in telescoping, concentric fashion from a number of isolator structures 136 that are secured to the mast 118 a predetermined distance from the lower end of the mast 118.

The isolator structures 136 each comprise a bracket formed from a pair of vertical plates 138 that are attached to the mast 118 in parallel relation to one another. A side isolator flange 140 is secured to the lower ends of the vertical plates 138. The side isolator flange 140 is secured both to the vertical plates 138 and to the mast 118. In one embodiment, bolt holes (not shown) are formed through the side isolator flange 140. The vertical plates 138 and side isolator flange 140 define a pocket, in which a side isolator buffer 142 is located. The side isolator buffer 142 is preferably formed from an elastomeric material. As an alternative, the side isolator buffer 142 may incorporate one or more springs in addition to or instead of the elastomeric material. Such a construction may be particularly advantageous for use in high temperature environments, for example, environments in which the temperature may exceed 180° F. Bolt holes (not shown) are formed through the side isolator buffer 142. When the side isolator buffer 142 is received within the pocket formed by the vertical plates 138 and the side isolator flange 140, the bolt holes formed through the side isolator buffer 142 are in registration with the bolt holes formed in the side isolator flange 140. A cover plate 144, which also has bolt holes (not shown) formed therethrough in registration with the bolt holes formed through the side isolator buffer 142 and through the side isolator flange 140, is received over the side isolator buffer 142 when the isolator buffer 142 is received in the pocket. Side isolator bolts 146 pass through the cover plate 144, the side isolator buffer 142, and the side isolator flange 140 to movably secure the recoil tube flange 132 to the guide column 102 of the rock breaking device 100. In some embodiments, for example, embodiments for use in high temperature environments, springs (not shown) may be located inside the side isolator buffer 142 and near the side isolator bolts 146. In practice, the isolator buffers 142 of the isolator structures urge the recoil tube flange 132 towards the under surface of the side isolator flanges 140 of the isolator structures 136.

In the embodiment shown in FIG. 2, each of the pockets formed by the vertical plates 138 and the side isolator flanges 140 is covered by a side isolator front plate 150 that extends beyond the lower side of the recoil tube flange 132. Each side isolator front plate 150 is welded to the corresponding side isolator flange 140 and to the vertical plates 138 and fits into a slot formed in the recoil tube flange 132.

The side isolator front plates 150 enhance the security of the positioning of the side isolator buffers 142 within the isolator structures 136 and constrain lateral expansion of the side isolator buffers 142 during impact and also during positioning of rocks with the device. In this way, the side isolator front plates 150 reduce the stress that is typically placed on the side isolator bolts 146, the side isolator buffers 142, and the portion of the mast 118 below the side isolator flange 140, particularly when positioning rocks with the tool 128 and the recoil tube 130. Adding the side isolator plates 150 may increase the life of these parts and improve the stability, strength, durability, and useful lifespan of the rock breaking device 100.

In some embodiments, a conventional rock breaking device can be retrofitted with the side isolator front plates 150. In particular, the side isolator front plates 150 are welded onto existing front plates of the isolator structures 136. The side isolator front plates 150 are positioned to extend beyond the lower side of the recoil tube flange 132 to provide greater strength. Each side isolator front plate 150 fits over the edge of the recoil tube flange 132, rather than in a slot formed in the recoil tube flange 132.

When excess force is applied to the recoil assembly 108, such as when the tool 128 is bottomed out or dry fired, the recoil assembly 108 is forced downward. This excess force causes the recoil assembly 108 to move downward relative to the guide column 102. Rather than applying these forces directly to the guide column 102, the downward movement of the recoil assembly 108 causes the side isolator bolts 146 in the isolator structures 136 to compress the side isolator buffers 142 and absorb the excess forces that were applied to the recoil assembly 108. As a result, stress can be placed on the side isolator bolts 146. The side isolator front plates 150 alleviate this stress, extending the life of the side isolator bolts 146.

Figure 3:
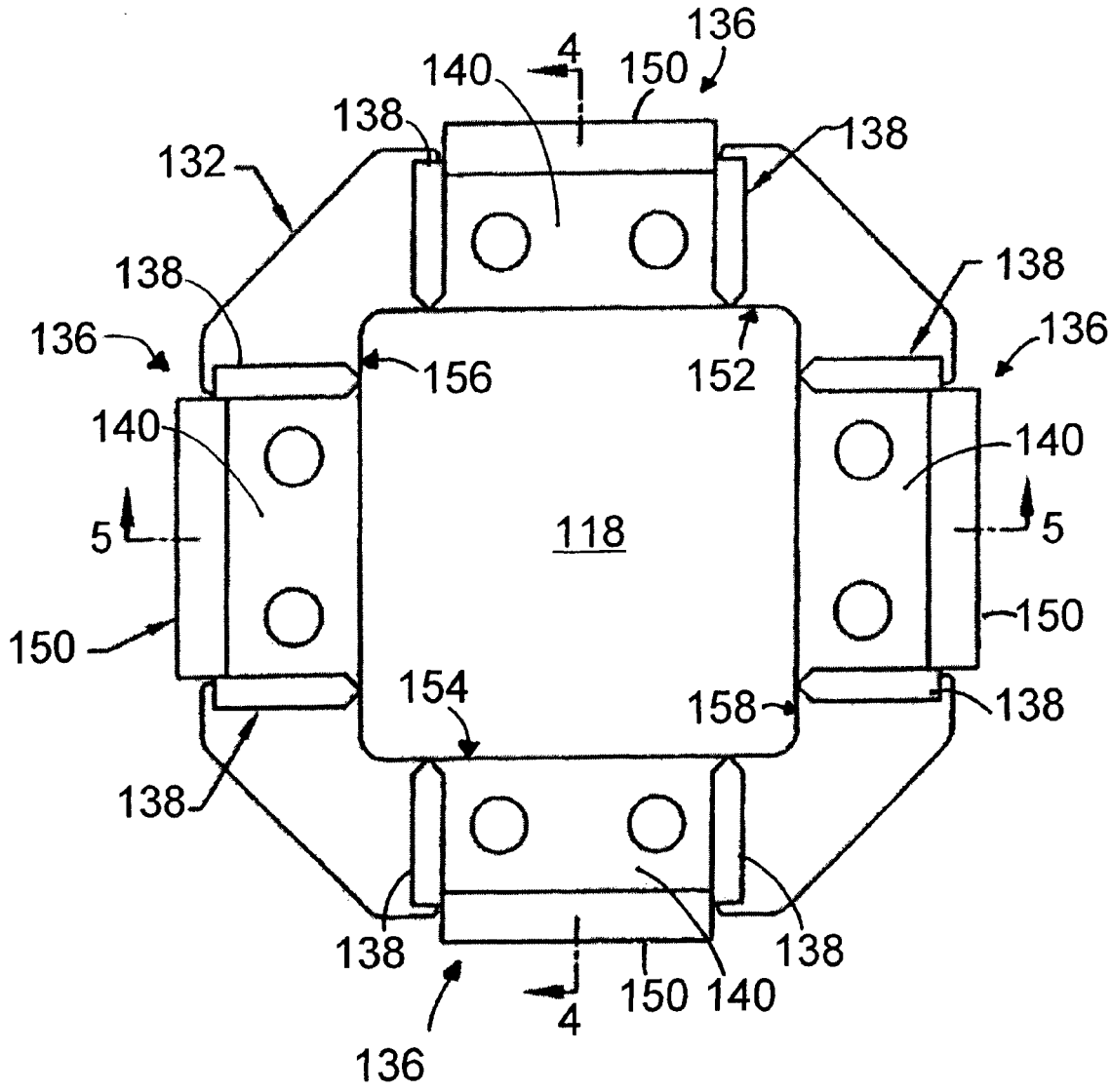
FIG. 3 is a sectional view of the recoil assembly of the rock breaking device depicted in FIGS. 1 and 2, taken along section lines 3-3 in FIG. 2.

FIG. 3 is a sectional view of the recoil assembly of the rock breaking device depicted in FIGS. 1 and 2, taken along section lines 3-3 in FIG. 2. In the embodiment depicted in FIG. 3, four isolator structures 136 are secured to the mast 118, one on each side of the mast 118. It will be appreciated by those of skill in the art that, while FIG. 3 depicts four isolator structures 136, other embodiments may employ more or fewer isolator structures 136. For example, if the recoil tube 130 has a polygonal cross-section, more than four isolator structures 136 may be secured to the mast 118. Each isolator structure 136 is formed by a pair of vertical plates 138, a side isolator flange 140, and a side isolator front plate 150. Each pair of vertical plates 138 and side isolator flange 140 forms a pocket that is covered by a side isolator front plate 150, which extends below the lower side of the recoil tube flange 132. In the embodiment illustrated in FIG. 3, the vertical plates 138 in each pair of vertical plates 138 are spaced apart from each other by approximately 11 inches, and the side isolator front plate 150 is spaced apart from the tubular mast 118 by approximately 5⅜ inches. Accordingly, in the embodiment of FIG. 3, the side isolator flanges 140 measure approximately 11 inches by 5⅜ inches. It will be appreciated that these and all other dimensions disclosed herein are intended as examples only, and that other dimensions may be selected in other embodiments. Each side isolator front plate 150 is welded to the corresponding side isolator flange 140 and to the corresponding vertical plates 138. The side isolator front plates 150 fit into slots formed in the recoil tube flange 132.

Figure 4:
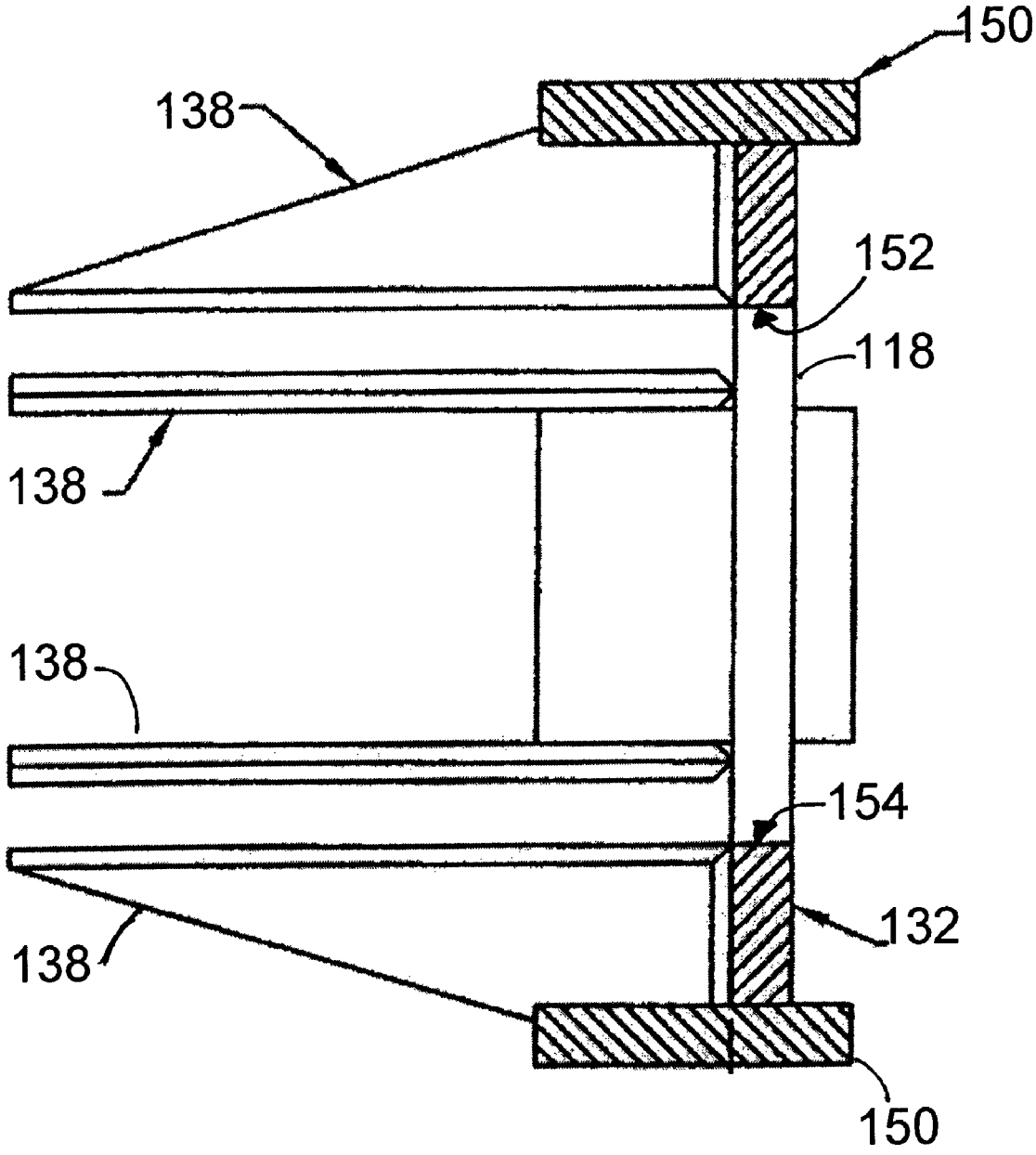
FIG. 4 is a sectional view of the recoil assembly of the rock breaking device depicted in FIGS. 1-3, taken along section lines 4-4 in FIG. 3.

FIG. 4 is a sectional view of the recoil assembly of the rock breaking device depicted in FIGS. 1-3, taken along section lines 4-4 in FIG. 3. In the embodiment shown in FIGS. 1-4, the vertical plates 138 forming each pair of vertical plates 138 are spaced apart from one another by approximately 11 inches. The vertical plates 138 forming pockets on opposite sides 152, 154 of the tubular mast 118 are spaced apart from each other by approximately 18¼ inches. The side isolator front plates 150 forming the pockets on the opposite sides 152, 154 of the tubular mast 118 are spaced apart from each other by approximately 28½ inches. The side isolator front plates 150 extend approximately 6½ inches above the recoil tube flange 132.

Figure 5:
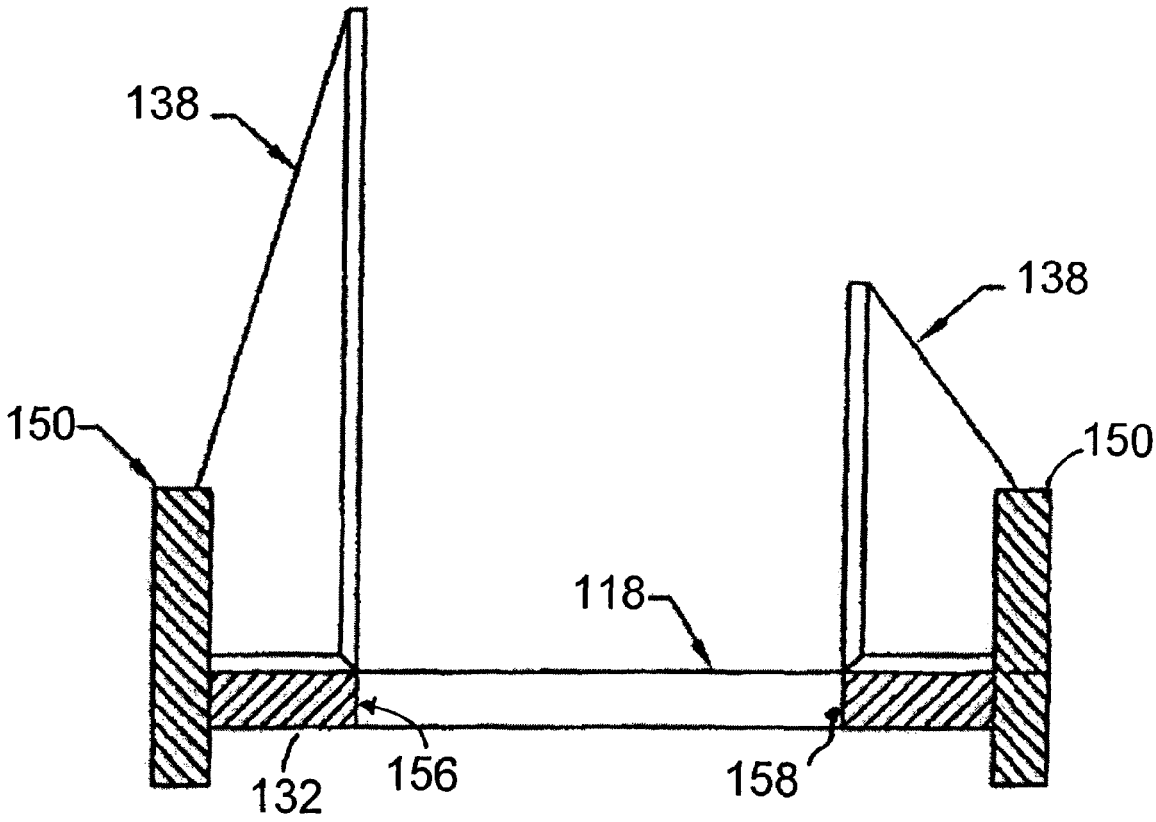
FIG. 5 is a sectional view of the recoil assembly of the rock breaking device depicted in FIGS. 1-3, taken along section lines 5-5 in FIG. 3.

FIG. 5 is a sectional view of the recoil assembly of the rock breaking device depicted in FIGS. 1-3, taken along section lines 5-5 in FIG. 3. In the embodiment shown in FIGS. 1-5, the vertical plates 138 forming pockets on opposite sides 156, 158 of the tubular mast 118 are spaced apart from each other by approximately 17¾ inches. In addition, as shown in FIG. 5, the vertical plates 138 may be of different sizes. For example, in the embodiment shown in FIG. 5, the vertical plates 138 forming the pocket on the side 156 of the tubular mast 118 are approximately 24 inches tall, while the vertical plates 138 forming the pocket on the side 158 of the tubular mast 118 are approximately 14 inches tall. The side isolator front plates 150 forming the pockets on the opposite sides 156, 158 of the tubular mast 118 are spaced apart from each other by approximately 28½ inches. The side isolator plates 150 extend approximately 6½ inches above the recoil tube flange 132 and are approximately 10½ inches in length, with a portion of that length extending below the recoil tube flange 132.

As indicated above in the discussion relating to FIG. 2, the recoil assembly 108 includes a recoil tube 130 having a recoil tube flange 132 and a lower flange 134 secured to the upper and lower ends, respectively, of the recoil tube 130. Referring again to FIG. 2, a number of reinforcing gussets 160 are secured between the recoil tube flange 132 and the lower flange 134. The gussets 160 are welded at their top edges to the under surface of the recoil tube flange 132 and at their bottom edges to the upper surface of the lower flange 134. In addition, the gussets 160 are preferably welded at an inner edge to the recoil tube 130. In one embodiment, at least four reinforcing gussets 160 are welded to the recoil assembly 108 to stiffen the recoil assembly 108.

A tool holding structure 112 is bolted to the lower flange 134 of the recoil assembly 108. The tool holding structure 112 includes a nose block 162, which may be implemented, for example, as a steel rectangular solid having a bore 164 formed therethrough. As shown in FIG. 2, the tool itself may be implemented as a striker pin 166 that is generally cylindrical in shape and that has an upper surface 168 that in operation is struck by the impact weight 104. The striker pin 166 also has a lower end portion 170 that serves as a cutting end. Although depicted in FIG. 2 as flat or blunt, the lower end portion 170 may alternatively be conical, pointed, or chisel-shaped, as needed for a particular task. The striker pin 166 has a flat 172 machined into one side thereof. A retaining pin, or shear pin, 174 is passed through the bore 164 in the nose block 162 and intersects the bore 164 so as to pass through the flat 172 machined into the striker pin 166. With the retaining pin 174 in place in the nose block 162, the vertical travel of the striker pin 166 is limited by the upper and lower ends of the flat 172.

The flat 172 that is machined into the striker pin 166 is arranged such that the lower end portion 170 of the striker pin 166 extends below the lower surface of the nose block 162. In addition, the upper surface 168 of the striker pin 166 is located above the upper surface of the nose block 162. The striker pin 166 extends through the lower flange 134 and into the space bounded by the recoil tube 130. At no time will the upper surface 168 of the striker pin 166 be positioned below the upper surface of the nose block 162. The isolator structures 136 are spaced from the lower end of the tubular mast 118 so as to ensure that the lower end of the tubular mast 118 is spaced away from the upper surface of the nose block 162 of the tool holding structure 112. Ensuring that space exists between the lower end of the tubular mast 118 and the upper surface of the nose block 162 prevents adverse impacts between the lower end of the tubular mast 118 and the nose block 162. The space between the lower end of the tubular mast 118 and the upper surface of the nose block 162 is bounded by the walls of the recoil tube 130.

In the embodiment shown in FIG. 2, the recoil tube 130 is sized so as to provide clearance between the outer surface of the tubular mast 118 and the inner surface of the recoil tube 130. This clearance prevents binding between the tubular mast 118 and the recoil tube 130 when the impact of the impact weight 104 must be absorbed by the recoil assembly 108.

To further cushion the impact of the impact weight 104 upon the recoil assembly 108, a recoil buffer 176 having a bore sized to accept the upper end portion of the striker pin 166 is located in the space between the upper surface of the nose block 162 and the lower end of the tubular mast 118. In its normal operating position, the lower end portion 170 of the striker pin 166 is placed on a rock to be broken and the upper end portion of the striker pin 166 extends upwardly through the nose block 162 and above the upper surface of the recoil buffer 176. It is intended that the impact weight 104 first strike the upper surface 168 of the striker pin 166, thereby transmitting the majority of the energy of the impact weight 104 to the striker pin 166 for the purpose of breaking the rock positioned below the striker pin 166.

As the striker pin 166 travels downward, the impact weight 104 comes into contact with the upper surface of the recoil buffer 176, which absorbs the forces not imparted to the striker pin 166 by the impact weight 104. The recoil buffer 176 is compressed vertically and simultaneously expands laterally toward the walls of the recoil tube 130. Where a great deal of force is applied to the recoil buffer 176, e.g., when the striker pin 166 is "bottomed out" or "dry fired" when the striker pin 166 is forcefully driven into the retaining pin 174 because there is no rock beneath the striker pin 166 or because the rock has been broken, the lateral expansion of the recoil buffer 176 will bring the peripheral edges of the recoil buffer 176 in contact with the inner walls of the recoil tube 130. Because the outwardly directed forces applied to the inner walls of the recoil tube 130 by the compressed recoil buffer 176 can exceed the strength of the recoil tube 130, the recoil buffer 176 is preferably sized to provide a space between the respective edges of the recoil buffer 176 and the inner walls of the recoil tube 130 to permit the recoil buffer 176 to absorb more force before coming into contact with the walls of the recoil tube 130. Further, because stresses may quickly become concentrated in the corners of a non-circular recoil tube, a chamfer or radius CR is preferably formed at each corner of the recoil buffer 176 to provide a larger space for lateral expansion of the recoil buffer 176 near the corners of a non-circular recoil tube 130. Alternatively, a circular recoil buffer 176 may be used.

The dimensions of the recoil buffer 176 and of the expansion space provided between the periphery of the recoil buffer 176 and the interior walls of the recoil tube 130 are a function of the size of the rock breaking device 100 and of the mass of the impact weight 104 being applied to the striker pin 166. The dimensions of the recoil buffer 176 and of the spaces around the recoil buffer 176 are preferably arranged so as to minimize the stresses applied laterally to the walls of the recoil tube 130.

The recoil buffer 176 is preferably fabricated from an elastomeric or other impact-absorbing material, such as polyurethane or rubber. The elastomeric material should be formulated to be sufficiently stiff and sufficiently resistant to breakdown due to the repetitive impacts by the impact weight 104. While the use of polyurethane or rubber is disclosed herein, those of ordinary skill in the art will appreciate that other materials having suitable spring coefficients and compressibility characteristics may be used instead. In some embodiments, particularly in environments in which the temperature may exceed 180° F., the recoil buffer 176 may incorporate one or more steel springs instead of or in addition to the elastomeric or other impact-absorbing material.

In one embodiment, the recoil buffer 176 is approximately five inches thick and approximately 14¾ inches square. In this embodiment, the recoil tube 130 is implemented as a square recoil tube having an inner diameter of approximately 18½ inches. The impact weight 104 used in this embodiment weighs approximately 4,200 pounds.

Because the lateral forces applied to the walls of the recoil tube 130 can only be minimized and not entirely prevented, reinforcing plates 178 are preferably positioned around the interior of the recoil tube 130 to present a stronger wall to the lateral expansion of the recoil buffer 176. The decreased space between the periphery of the recoil buffer 68 and the inner surface of the recoil tube 130 as defined by the inner surface of the reinforcing plates 178 should be taken into account when sizing the recoil buffer 176. In the embodiment shown in FIG. 2, there is an approximately ⅜ inch gap between the periphery of the recoil buffer 176 and the reinforcing plates 178.

The rock breaking device 100 described herein is used to break up rocks that are present in quarrying and mining sites. It may also be used to drive piles. In breaking a targeted rock, the rock breaking device 100 is brought into position adjacent the targeted rock by driving the vehicle that mounts the rock breaking device 100 up to the targeted rock. The arms of the vehicle are then used to orient the rock breaking device 100 over the targeted rock so as to position the lower end portion 170 of the striker pin 166 on the targeted rock. Once the striker pin 166 has been properly located above the targeted rock, the impact weight 104 is raised by the weight raising mechanism 106 within the guide column 102. The weight raising mechanism 106 then releases the raised impact weight 104, causing the potential energy of the raised impact weight 104 to be converted to kinetic energy that is in turn transmitted through the striker pin 166 to the targeted rock. The striker pin 166 is then either repositioned to either direct another impact to the targeted rock or to put the striker pin 166 into contact with a second rock that is to be broken. The impact weight 104 is again raised and released until the rock or rocks are broken.

If the impact weight 104 is released by the weight raising mechanism 106 without a rock being positioned under the striker pin 166, it is very probable that the impact weight 104 will bottom out the striker pin 166 against the retaining pin 174. This situation is highly undesirable in that such impacts may damage or break the retaining pin 174, thereby necessitating repair to the rock breaking device 100. However, the recoil assembly 108 is arranged and constructed such that the forces imparted to the bottomed out striker pin 166 will be absorbed by the recoil buffer 176 and by the side isolator buffers 142. The recoil buffer 176 and the side isolator buffers 142 prevent damage to the guide column 102 and to the nose block 162. In order to prevent serious damage to the rock breaking device 100, the retaining pin 174 is preferably fabricated from a material that will fail before the nose block 162 or the guide column 102 is damaged or destroyed. In this way, the retaining pin 174 will, as it is being destroyed, absorb additional energy that would otherwise be applied in a destructive manner to the recoil assembly 108 and to the guide column 102.

As described above, considerable stress is placed on the portion of the mast 118 located below the side isolator flange 140, as well as on the side isolator bolts 146, and the side isolator buffers 142 when the striker pin 166, the nose block 162, and the recoil tube 130 are used to position rocks. According to the various embodiments disclosed herein, the side isolator front plates 150 may bolster the side isolator buffers 142 and prolong their useful lifespan, as well as the useful lifespan of the mast 118 and the side isolator bolts 146. As a result, the dependability of the rock breaking device 100 may be enhanced.

As demonstrated by the foregoing discussion, various embodiments may provide certain advantages, particularly in the context of breaking rocks. For instance, when the striker pin, the nose block, and the recoil tube are used to position rocks for breaking, a great deal of stress can be placed on the portion of the mast below the side isolator flange, the side isolator bolts, and the side isolator buffers. Adding the plates to the isolator structures may increase the life of these parts and make the rock breaking device more dependable.

It will be understood by those who practice the embodiments described herein and those skilled in the art that various modifications and improvements may be made without departing from the spirit and scope of the disclosed embodiments. The scope of protection afforded is to be determined solely by the claims and by the breadth of interpretation allowed by law.

What is claimed is:

1. A device for breaking rocks, the device comprising:

a hollow mast having an upper end portion and a lower end portion that define a vertical axis, the mast having a channel running at least substantially parallel to the vertical axis;

a weight slidably disposed in the channel;

a weight raising arrangement for raising and releasing the weight to allow the weight to fall within the channel under the influence of gravity;

a recoil arrangement comprising:

a recoil tube having an internal surface, an external surface, an upper end portion and a lower end portion, the recoil tube operatively connected to the mast so that it can move relative thereto, and so that the internal surface of the recoil tube is located proximate the external surface of the lower end portion of the mast and the lower end portion of the recoil tube extends below the lower end portion of the mast, an upper flange secured to an external surface of the upper end portion of the recoil tube such that the upper flange is generally perpendicular to the vertical axis, the upper flange having an outwardly extending upper surface, an outwardly extending lower surface, and a peripheral edge spanning the upper and lower surfaces, with the peripheral edge having an inwardly extending, generally u-shaped transverse slot, and a lower flange secured to the lower end portion of the recoil tube;

an isolator arrangement comprising:

an isolator structure secured proximate the lower end portion of the mast and proximate the upper surface of the upper flange, the isolator structure arranged to support the recoil tube, and an isolator plate secured to the isolator structure, with a portion of the isolator plate extending below the isolator structure and with said portion being spaced from the recoil tube and movably received by the transverse slot as the recoil tube moves relative to the mast;

a nose block secured proximate the lower end portion of the recoil tube, the nose block having an upper surface and a bore formed through the nose block so as to slidably receive a tool therein; and an impact-absorbing recoil buffer disposed within the recoil tube in a space defined between the lower end portion of the mast and the upper surface of the nose block, the recoil buffer being constructed and arranged to resiliently absorb impact forces imparted to the recoil buffer by the weight.

2. The device of claim 1, wherein the upper flange substantially encircles the recoil tube, wherein the peripheral edge of the upper flange further comprises a plurality of inwardly extending, generally u-shaped transverse slots, and wherein the device further comprises a plurality of isolator arrangements, each isolator arrangement comprising:

an isolator structure secured proximate the lower end portion of the mast and proximate the upper surface of the upper flange, the isolator structure arranged to support the recoil tube; and an isolator plate secured to the isolator structure, with a portion of the isolator plate extending below the isolator structure and with said portion being spaced from the recoil tube and movably received by one of the transverse slots as the recoil tube moves relative to the mast.

3. The device of claim 1, wherein the isolator structure comprises:

a plurality of plate members secured to the mast so that they are generally parallel with the vertical axis of the mast, and so that the plate members generally parallel with one another; and an isolator flange secured to the mast and to the plate members in a generally perpendicular relationship, with the plate members, the isolator flange, the isolator plate, and a portion of the mast, arranged to define an isolator pocket; and an isolator buffer disposed within the isolator pocket.

4. The device of claim 1, wherein the tool is retained in the bore formed through the nose block by a pin passed through the nose block.

5. The device of claim 4, wherein the tool has a flat machined into a side of the tool to permit the pin to intersect and pass through the bore formed through the nose block, thereby retaining the tool in the bore formed through the nose block.

6. The device of claim 1, wherein the recoil buffer has a bore formed through the recoil buffer in alignment with the bore formed through the nose block to allow an upper end portion of the tool to extend above the recoil buffer so that the weight may impact the tool directly.

7. The device of claim 1, wherein the isolator structure comprises:

a plurality of plate members secured to the mast such that they are generally parallel with the vertical axis of the mast, the plate members generally parallel with one another; and a flange having an upper surface and a bottom surface, the flange secured to the mast and to portions of the plate members;

wherein the isolator plate is secured to portions of the plate members and the flange, and wherein a portion of the isolator plate extends below the bottom surface of the flange.

8. The device of claim 7, wherein the plate members, the flange, the isolator plate, and a portion of the mast form an upwardly opening pocket.

9. The device of claim 1, wherein the recoil tube is movable between a first position where the upper surface of the upper flange is adjacent a bottom surface of the isolator structure, and a second position where the upper surface of the upper flange is spaced below the bottom surface of the isolator structure, and wherein the portion of the isolator plate that extends below the isolator structure and into the transverse slot is constrained for movement within the transverse slot as the recoil tube moves between the first position and the second position.

10. A rock breaking device comprising:

a hollow mast having an upper end portion, a lower end portion, a vertical axis and a channel running at least substantially parallel to the vertical axis;

a weight slidably disposed in the channel;

a weight raising arrangement for raising and releasing the weight to allow the weight to fall within the channel under the influence of gravity;

a recoil arrangement comprising:

a recoil tube having an upper end portion and a lower end portion operatively connected to the mast so that it can move relative thereto, and so that the upper end portion of the recoil tube is located proximate the lower end portion of the mast and the lower end portion of the recoil tube extends below the lower end portion of the mast, and a panel-shaped upper flange secured to an external surface of the upper end portion of the recoil tube such that a plane defined by the upper flange is generally perpendicular to the vertical axis, the upper flange having an outwardly extending upper surface, an outwardly extending lower surface and a peripheral edge spanning the upper and lower surfaces;

a tool holding structure secured proximate the lower end portion of the recoil tube and configured to receive a tool;

an impact-absorbing recoil buffer disposed within the recoil tube in a space defined between the lower end portion of the mast and the upper surface of the nose block, the recoil buffer being constructed and arranged to resiliently absorb impact forces imparted to the recoil buffer by the weight ; and an isolator arrangement comprising an isolator structure secured proximate the lower end portion of the mast and proximate the upper surface of the upper flange, the isolator structure arranged to support the recoil tube, and an isolator plate secured to the isolator structure, with a portion of the isolator plate extending below the isolator structure in a generally cantilever fashion, with the portion spaced outwardly from the recoil tube, with the portion positioned adjacent the peripheral edge of the upper flange and with the portion extending below the lower surface of the upper flange, said portion being movable with respect to the peripheral edge of the upper flange as the recoil tube moves relative to the mast, wherein the isolator plate alleviates stresses imparted to the rock breaking device when the recoil arrangement, tool holding structure, and tool are used to position a rock for breaking.

11. The rock breaking device of claim 10, further comprising a plurality of isolator arrangements, each isolator arrangement comprising:

an isolator structure secured proximate the lower end portion of the mast and proximate the upper surface of the upper flange, the isolator structure arranged to support the recoil tube; and an isolator plate secured to the isolator structure, with a portion of the isolator plate extending below the isolator structure in a generally cantilever fashion, with the portion spaced outwardly from the recoil tube, with the portion positioned adjacent the peripheral edge of the upper flange and with the portion extending below the lower surface of the upper flange, wherein the isolator plate is arranged to alleviate stresses imparted to the rock breaking device when the recoil arrangement, tool holding structure, and tool are used to position a rock for breaking.

12. The rock breaking device of claim 10, wherein the isolator structure comprises:

a plurality of plate members secured to the mast so that they are generally parallel with the vertical axis of the mast, and so that the plate members are generally parallel with one another; and an isolator flange secured to the mast and to the plate members in a generally perpendicular relationship, with the plate members, the isolator flange, the isolator plate, and a portion of the mast arranged to define an isolator pocket; and an isolator buffer disposed within the isolator pocket.

13. An isolator assembly for use with a rock breaking device of the type having a hollow mast having an external surface, a lower end portion, an upper end portion and a vertical axis, and a recoil tube having an internal surface, an external surface, an upper end portion and a lower end portion, with the recoil tube operatively connected to the mast so that the internal surface of the recoil tube is located proximate the external surface of the lower end portion of the mast and the lower end portion of the recoil tube extends below the lower end portion of the mast in a telescopic relation, with the recoil tube movable relative to the mast along the vertical axis in a constrained manner, the isolator assembly comprising:

an isolator arrangement comprising a generally u-shaped isolator structure having opposing, spaced-apart sides and a bottom flange that are connected to each other, the sides and bottom flange defining an inner, mast facing edge and an outer facing edge that is spaced from the inner, mast facing edge, with the inner mast facing edge configured and arranged to be fixedly attached to the external surface of the mast, proximate the lower portion of the mast;

an isolator plate configured and arranged to be fixedly attached to the outer facing edge of the generally u-shaped the isolator structure such that a portion of the isolator plate extends above the bottom flange and a portion of the isolator plate extends below the bottom flange in a cantilever manner, with the portion of the plate that extends below the bottom flange in substantial alignment with the vertical axis and spaced outwardly away from the external surface of the recoil tube, wherein the u-shaped isolator structure, the isolator plate and the external surface of the mast to which the isolator structure is fixedly attached form an upwardly opening pocket; and a recoil tube flange having a panel-shaped body with an upper surface, a lower surface, an inner facing edge and an outer facing peripheral edge spanning the upper and lower surfaces, wherein the peripheral edge of the recoil tube flange includes an inwardly extending generally u-shaped transverse slot, with the recoil tube flange attachable to the external surface of the upper end portion of the recoil tube so that the inner facing edge is adjacent the exterior surface of the recoil tube and so that a plane defined by the panel-shaped body of the recoil tube flange is substantially perpendicular to the vertical axis of the recoil tube, with the recoil tube flange positioned so that the peripheral edge is in a laterally adjacent relationship with the portion of the isolator plate that extends below the bottom of the isolator structure, wherein the portion of the isolator plate that extends below the bottom flange of the isolator structure is movably received in the transverse slot in a laterally adjacent relationship, and wherein the portion of the isolator plate that extends below the bottom of the isolator structure also extends below the lower surface of the recoil tube flange, with the recoil tube flange connected to a resilient buffer element carried by the u-shaped isolator structure such that when the recoil tube moves downwardly and upwardly relative to the mast, the peripheral edge of the recoil tube flange is able to maintain the laterally adjacent relationship with the portion of the isolator plate that extends below the bottom flange of the isolator structure.

14. The isolator assembly of claim 13, wherein the portion of the isolator plate that extends above the bottom flange and the portion of the isolator plate that extends below the bottom flange is in a ratio of approximately 1.5 to 1.0.

15. The isolator assembly of claim 13, wherein the resilient buffer element may be compressed a predetermined distance in a direction parallel to the vertical axis of the mast, wherein the portion of the isolator plate that extends below the bottom flange has a length, and wherein the length of said isolator plate is larger than the predetermined distance that the resilient buffer element may be compressed.

16. The isolator assembly of claim 13, wherein the upper flange substantially encircles the recoil tube, the isolator assembly further comprises a plurality of isolator arrangements, with the isolator arrangements spaced about the external surface of the mast in a common transverse plane, and with each isolator arrangement comprising:

a generally u-shaped isolator structure having opposing, spaced-apart sides and a bottom flange that are connected to each other, the sides and bottom flange defining an inner, mast facing edge and an outer facing edge that is spaced from the inner, mast facing edge, with the inner mast facing edge configured and arranged to be fixedly attached to the external surface of the mast, proximate the lower portion of the mast; and an isolator plate configured and arranged to be fixedly attached to the outer facing edge of the generally u-shaped the isolator structure such that a portion of the isolator plate extends above the bottom flange and a portion of the isolator plate extends below the bottom flange, wherein the u-shaped isolator structure, the isolator plate and the external surface of the mast to which the isolator structure is fixedly attached form an upwardly opening pocket and wherein the portion of the isolator plate that extends below the bottom flange of the isolator structure also extends below the lower surface of the recoil tube flange.

17. The isolator assembly of claim 13, wherein the peripheral edge of the upper flange comprises a plurality of inwardly extending, transverse slots, wherein the transverse slots are substantially symmetrically located about the peripheral edge, wherein each isolator arrangement is located in close proximity to a respective transverse slot, and wherein the portion of the isolator plate that extends below the bottom flange of the isolator structure is received by a respective transverse slot in a laterally adjacent relationship.

* * * * *